United States Patent [19]

Posson

[11] 4,174,930

[45] Nov. 20, 1979

[54] ROTARY ENGINE

[76] Inventor: Chester A. Posson, 4651 Teonia Woods Rd., Rolling Meadows, Ill. 60008

[21] Appl. No.: 853,100

[22] Filed: Nov. 21, 1977

[51] Int. Cl.[2] ..... F02B 53/00

[52] U.S. Cl. ..... 418/36

[58] Field of Search ..... 123/245; 418/33, 35, 418/36

[56] References Cited

U.S. PATENT DOCUMENTS

| | | | |
|---|---|---|---|
| 1,962,408 | 6/1934 | Powell | 418/36 |
| 3,294,071 | 12/1966 | Turco | 418/36 X |
| 3,356,079 | 12/1967 | Rolfsmeyer | 418/36 |
| 4,086,879 | 5/1978 | Turnbull | 123/245 X |

*Primary Examiner*—Michael Koczo

*Attorney, Agent, or Firm*—Fitch, Even & Tabin

[57] ABSTRACT

A rotary engine is disclosed having two pairs of blade pistons each of which is carried on a separate one of a pair of coaxial shafts facilitating relative rotational movement between the blade pistons within an annular chamber. The coaxial shafts are cooperative with a main power shaft through a motion translation mechanism which controls movement of the pistons about their common axis so that the pistons have uniform alternating accelerating and retarding rotary movements facilitating cyclical movement of the pairs of pistons to establish intake, compression, ignition and exhaust cycles at predetermined arcuate positions about the annular chamber.

8 Claims, 5 Drawing Figures

ROTARY ENGINE

The present invention relates generally to rotary engines, and more particularly to a rotary engine utilizing rotatable pairs of radial pistons and having novel motion translation mechanism for effecting predetermined rotational movement of the pistons relative to each other to facilitate intake, compression, power and exhaust cycles during operation of the rotary engine.

Rotary engines, and more particularly rotary internal combustion engines, which employ pairs of radial pistons rotatable within annular chambers and operative to drive an output power shaft are generally known. See, for example, U.S. Pat. Nos. 1,497,481, 3,356,079 and 3,500,798. In substantially all rotary type engines, means are employed to effect predetermined relative rotational movement between the pairs of radial pistons so as to effect unidirectional rotation of the power output shaft during cycles of intake, compression, ignition and exhaust. The pistons are conventionally arranged in pairs of diametrically opposite rigidly connected blade pistons or rotors disposed within an annular chamber and alternately rotatable about a common axis relative to each other and to the piston chamber, with a motion translation mechanism connecting the pistons to the output shaft so as to cause first one pair of blade pistons and then the other pair to become the accelerated pistons in alternate relation throughout operation of the rotary engine.

One of the primary objects of the present invention is to provide a novel motion translation mechanism for connecting pairs of radial pistons to an output shaft in a rotary type engine so as to effect predetermined relative rotation of the pistons within a piston chamber while maintaining unidirectional rotation of the output shaft.

A more particular object of the present invention is to provide a rotary engine having novel mechanism interconnecting pairs of radial pistons to an output shaft, which mechanism is operative to effect predetermined relative rotational movement between pairs of blade pistons within an annular chamber so as to cause each pair of pistons to alternately undergo rotation relative to the piston chamber during power strokes while the other pair of pistons remains substantially stationary relative to the chamber, such relative movement being effected without the use of complex planetary gear arrangements or slider mechanisms as have heretofore been employed in rotary engines.

In carrying out a preferred embodiment of the present invention, a pair of pistons, each of which defines two diametrically opposed blade pistons, are supported on coaxial support shafts within a piston chamber for rotation about the axis of the coaxial shafts. The coaxial support shafts carry miter gear segments which are operatively interconnected to a power output shaft through a motion translation mechanism including carrier ring means carrying gear segments cooperable with the gear segments on the coaxial shafts to translate rotation to the power output shaft. A control ring is rotatably driven by the power output shaft in a direction opposite to the rotational direction of the pistons and has cooperation with the carrier ring means so that, in alternating fashion, one of the pistons undergoes rotation relative to the piston chamber during a power stroke while the other piston remains substantially stationary relative to the piston chamber. After each power stroke, the pistons are rotated simultaneously to position a new fuel charge in proper location for the next power stroke. In the described embodiment, the motion translation mechanism is operative to effect uniform alternating movement of the pistons so that four power cycles are effected during each revolution of the power output shaft.

The various objects, features and advantages of the present invention, together with the organization and manner of operation thereof, will become apparent from the following detailed description of the invention when taken in connection with the accompanying drawings wherein like reference numerals designate like elements throughout the several views, and wherein.

Figure 1:
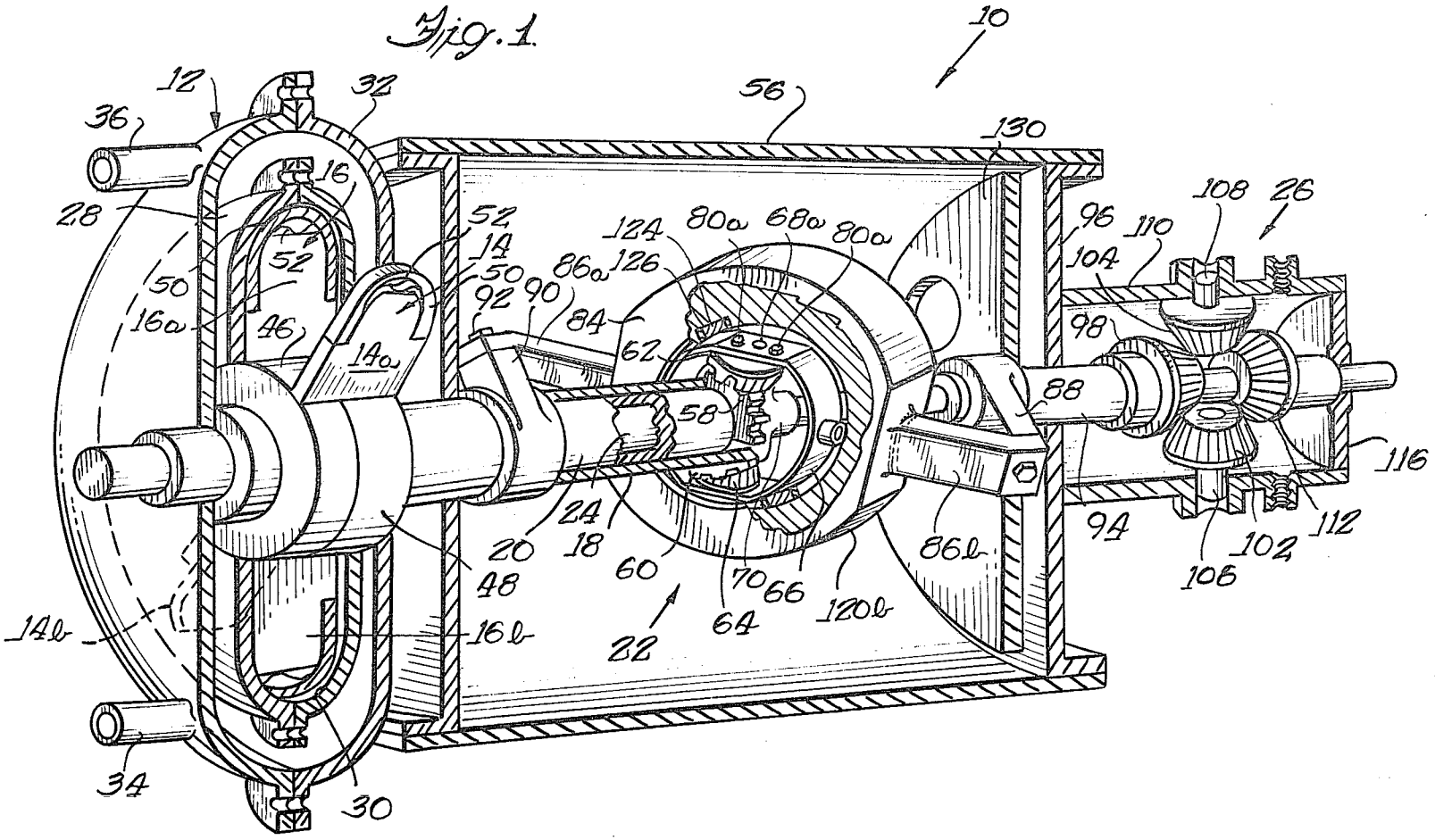
FIG. 1 is a fragmentary perspective view of a rotary engine constructed in accordance with the present invention.

Referring now to the drawings, and in particular to FIG. 1, a rotary engine constructed in accordance with the present invention is indicated generally at 10. The rotary engine 10, which is described hereinafter for illustration purposes as comprising a four-cycle engine, includes a piston block or housing 12 in which is mounted a pair of pistons 14 and 16, respectively, on coaxial tubular shafts 18 and 20. The shafts 18 and 20 are operatively associated with motion translation mechanism means, indicated generally at 22, to effect driving rotation of a power output shaft 24 extending the full longitudinal length of the rotary engine and defining its longitudinal axis.

The power output shaft 24 extends axially through and has cooperation with a return gear assembly, indicated generally at 26, which cooperates with the motion translation mechanism 22 to effect a predetermined sequential movement of the pistons 14 and 16 as will become more apparent hereinbelow. Briefly, the pistons 14 and 16 are adapted to rotate about the axis of the output shaft 24 in predetermined uniform rotational relation to each other and to the housing 12 so that first one of the pistons undergoes rotational movement in a forward rotational direction during a power cycle while the other piston remains substantially stationary relative to the piston housing to establish a reaction surface boundary for the combustion chamber, whereafter the piston previously rotated during a forward power stroke becomes the relatively stationary reaction piston while the other piston undergoes rotational movement in a power stroke, successive alternate movements of the pistons during intake, compression, power and exhaust cycles serving to effect unidirectional rotation of the power output shaft 24. The desired relative movements of the pistons 14 and 16 during operation of the rotary engine is effected by the motion translation mechanism 22 which may alternatively be termed a transmission and which is operative to move the pistons simultaneously in a forward rotational direction at the end of each power cycle or stroke to properly position the pistons preparatory to each successive power cycle.

Figure 2:
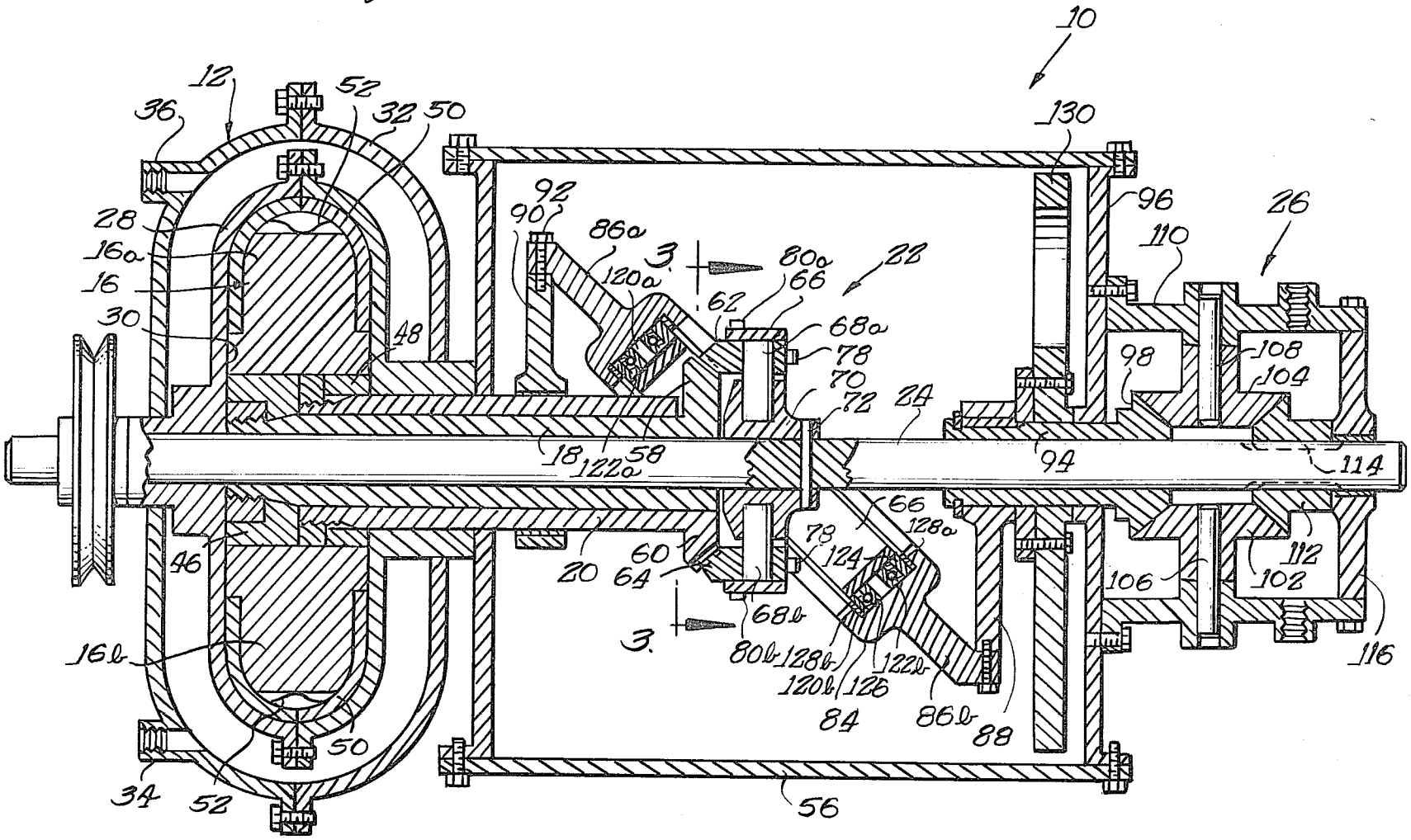
FIG. 2 is a longitudinal sectional view of the rotary engine taken from above and at an angle to the view of FIG. 1.

Referring particularly to FIGS. 1 and 2, the piston block 12 has an inner piston housing 28 which defines an internal substantially closed piston chamber 30 in which the pistons 14 and 16 are supported. An outer water jacket 32 surrounds the inner piston housing 28 and has an inlet 34 and an outlet 36 for circulating a suitable coolant over the piston housing 28. The piston housing 28 and outer jacket 32 are preferably sectioned along a parting plane perpendicular to the axis of the drive shaft 24 to facilitate assembly and disassembly.

Figure 4:
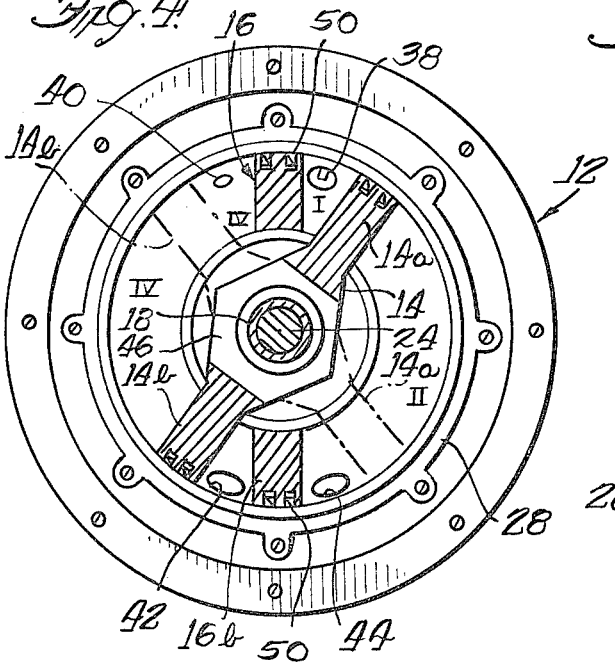
FIGS. 4 and 5 are fragmentary transverse sectional views through the piston chamber and show the pairs of blade pistons in various operating positions during operation of the engine.
Figure 5:
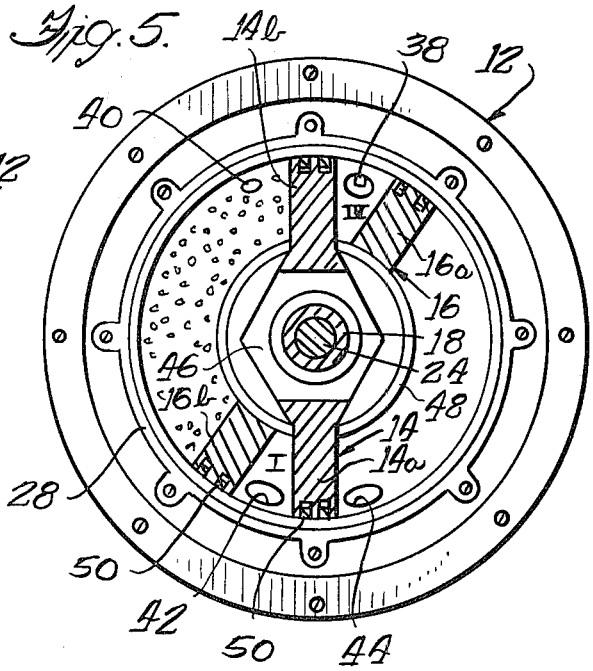

As best seen in FIGS. 4 and 5, the piston housing 28 is provided with ignition means, such as a spark plug 38, a fuel injection port 40, an air intake port 42 and an exhaust port 44, all of which communicate with the piston chamber 30 and are disposed in predetermined relation circumferentially about the piston chamber, as will be described in greater detail hereinbelow.

The pistons 14 and 16 are similar in configuration and are mounted on their respective support shafts 18 and 20 through annular hubs 46 and 48, respectively, suitably secured to the respective coaxial support shafts. The piston 14 defines diametrically opposed radially extending blade pistons or rotors **14*a* and 14*b* suitably mounted on the hub 46. Each of the blade pistons 14*a* and 14*b* carries one or more U-shaped piston seals 50 which are biased outwardly against the opposed inner surface of the chamber 30 by a suitable spring 52** so as to prevent leakage of the working gases past the pistons during operation, as is known.

The piston 16 similarly defines a pair of diametrically opposed radially directed blade pistons **16*a* and 16*b* which are preferably formed integral with the hub 48 and which also carry suitable piston seals 50 for sealing engagement with the interior surface of the piston chamber 30. The blade pistons 14*a*, *b* thus have synchronous movement with each other and may be rotated independently of but in predetermined relation to the blade pistons 16*a*, *b*. Conversely, the blade pistons 16*a*, *b* have synchronous movement with each other and may be rotated substantially independently of but in predetermined relation to the pistons 14*a*, *b*. The pistons 14 and 16 are mounted within the chamber 30 such that the blade pistons 14*a*, *b* and 16*a*, *b* are disposed in alternating relation circumferentially of the piston chamber. In the illustrated embodiment, it is seen that the outer surfaces of the piston seals 50 and the opposing inner surface of the combustion chamber 30 are generally semi-circular although other configurations could be employed. The outer housing 12, inner piston housing 28 and pistons 14 and 16** are substantially identical to the pistons or rotors and associated housing disclosed in my copending application, Ser. No. 772,085, filed Feb. 25, 1977, and now U.S. Pat. No. 4,136,661, which is incorporated herein by reference.

Figure 3:
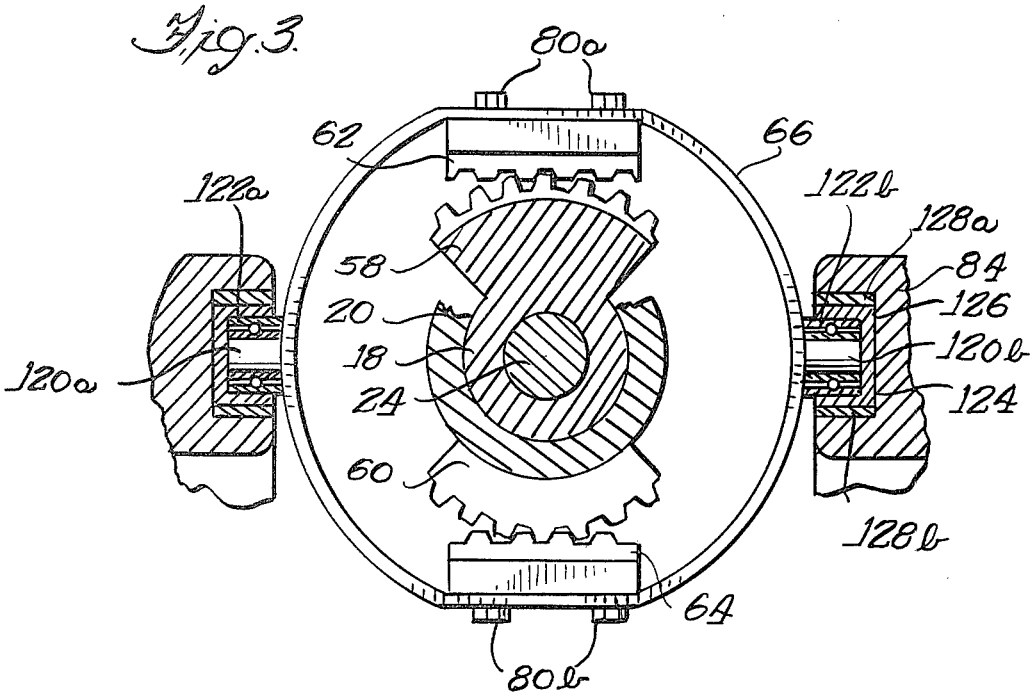
FIG. 3 is a fragmentary transverse sectional view taken substantially along the line 3—3 of FIG. 2, looking in the direction of the arrows.

It is seen from FIGS. 1 and 2, taken in conjunction with FIG. 3, that the coaxial shafts 18 and 20 extend within a housing 56 and have miter gear segments 58 and 60, respectively, formed integral therewith or otherwise suitably mounted on the ends thereof opposite the pistons 14 and 16. The gear segments 58 and 60 are identical in configuration and each preferably comprises an approximately one-fourth segment of a circular miter gear. The gear segments 58 and 60 mesh, respectively, with similarly configured miter gear segments 62 and 64 carried by an annular carrier ring 66 so as to lie in planes at right angles to the planes of the miter gears 58 and 60.

The carrier ring 66 is secured to a pair of axially aligned, diametrically opposed pivot shafts **68*a* and 68*b* rotatably mounted on a connecting block 70 which, in turn, is fixed on the power output shaft 24 for driving rotation therewith by a connecting pin 72. The gear segments 62 and 64 are preferably secured to both their respective pivot shafts 68*a*, *b*, as by screws 78, and to the carrier ring 66, as through pairs of screws 80*a* and 80*b* so that the gear segments 62 and 64 are coupled to the carrier ring 66 and the pivot shafts 68*a*, *b*** for conjoint rotation about the axis of the pivot shafts.

It can be seen that rotating either one of the piston support shafts 18 or 20 about its longitudinal axis, for example, in a clockwise direction as considered in FIG. 3, will tend to rotate the connecting block 70 and power output shaft 24 in a corresponding rotational direction while simultaneously tending to rotate the carrier ring 66 about the axis of the pivot shafts **68*a*, *b*. Effecting rotation of the carrier ring 66 about the axis of the pivot shafts 68*a*, *b* by driving rotation of one of the coaxial piston shafts, such as 18, causes the other piston shaft 20 to remain relatively stationary due to interengagement of the associated gear segment 60 with the gear segment 64 carried by ring 66**, as will become more apparent hereinbelow.

It will be appreciated that if the carrier ring 66 were free to rotate about the axis of the pivot shafts **68*a*, *b* in an unconstrained manner, rotation of one of the piston shafts 18 or 20 could result in at least partial rotation of the carrier ring about the axis of the pivot shafts without also undergoing rotation about the axis of power output shaft 24. To prevent such "free" rotation of the carrier ring 66 and thus insure rotation of the carrier ring about the axes of both the pivot shafts 68*a*, *b* and the power output shaft 24 in a predetermined manner, the motion translation mechanism 22 includes control means in the form of a control ring 84 operatively associated with the carrier ring 66 and the power output shaft 24 and adapted to establish predetermined movement of the carrier ring and thus predetermined relative movement between the pistons 14 and 16 during operation of the rotary engine 10. As will become apparent hereinbelow, the control ring 84 is operative to reverse the rotational direction of the carrier ring 66 about the axis of pivot shafts 68*a*, *b* at each half revolution of output shaft 24 so that rotational motion imparted to the carrier ring by alternate ones of the gear segments 58 and 60 effects unidirectional rotation of the power output shaft. The control ring 84 also effects simultaneous rotation of the pistons 14 and 16 during predetermined periods of each revolution of the power output shaft 24**.

The control ring 84 has a pair of diametrically opposed, radially extending support arms **86*a*, *b* which facilitate mounting of the control ring on a pair of support legs 88 and 90 so that the power output shaft 24 passes through the axis of the control ring. In the illustrated embodiment, the control ring 84 is mounted so as to lie in a plane subtending an angle of approximately 49° with the axis of the output shaft 24**.

The angular relationship "D" of the plane of the control ring 84 relative to the axis of the power output shaft 24, i.e. the angle subtended between the plane of the control ring and the axis of the power output shaft, may be calculated according to the following mathematical equation:

$$D=90^\circ-[360^\circ-((4A/B)\times 360^\circ)/8\,]$$

Where:

"A" is the thickness, in inches, of the blade pistons 14*a, b* and 16*a, b* considered transverse to their radial lengths, as in FIG. 4; and "B" is the outer circumference, in inches, of the piston hubs 46 and 48 at their connection to the blade pistons.

Thus, for a blade piston thickness "A" of 0.5", and an outer circumference "B" of 20" for the piston hubs 46 and 48, "D" would be 49° 33', or approximately 49°.

The support leg 90 is journaled on the piston shaft 20 so as to be rotatable in a plane normal to the axis of the power output shaft 24. The support arm 86*a* may be secured to the support leg 90 in any suitable manner such as by one or more screws 92.

The support leg 88 is fixedly mounted on a tubular shaft 94 which, as best seen in FIG. 2, extends through an end wall 96 of the housing 56. The end of the shaft 94 opposite the support leg 88 has a miter gear 98 formed thereon which has mating relation with a pair of idler miter gears 102 and 104 fixed on axially aligned support shafts 106 and 108, respectively. The support shafts 106 and 108 are suitably journaled within a housing 110 mounted on the end wall 96 of the housing 56 in axial alignment therewith. The miter gears 102 and 104 are in driven meshing relation with a miter gear 112 fixed on the power output shaft 24 through a drive key 114. The housing 110 encloses the miter gears 98, 102, 104 and 112 to establish the return gear assembly 26, and has an end wall 116 through which the output shaft 24 is journaled.

It will be appreciated that while the gear segments 58, 60, 62 and 64 have been described as miter gears, other bevel gear designs may be employed where a pitch diameter ratio other than 1:1 is desired between mating pairs of gears.

By fixing the control ring 84 to the shaft 94 which is connected in driven relation to the power output shaft 24 through the return gear assembly 26, it can be seen that rotation of the power output shaft will effect rotation of the control ring 84 about the axis of the power output shaft in a rotational direction opposite to that of the power output shaft.

As aforementioned, the control ring 84 is operatively associated with the carrier ring 66 to establish predetermined movement of the carrier ring during rotation of the carrier ring about the axis of the power output shaft 24. To this end, the carrier ring 66 has a pair of diametrically opposed radial stub shafts 120*a* and 120*b* mounted thereon each of which is received within a suitable antifriction bearing 122*a, b*, respectively, carried in an annular slide ring 124. The slide ring 124 is rotatable within an annular raceway 126 formed in the control ring 84. Preferably annular planar bearing races 128*a, b* are disposed between the lateral side surfaces of the slide ring 124 and the opposed walls of the raceway 126.

By so mounting the carrier ring 66 in the control ring 84, it will be appreciated that as the control ring rotates about the axis of the power output shaft 24 simultaneously with but in an opposite rotational direction to rotation of the carrier ring 66, the carrier ring 66 is caused to undergo uniform cyclical rotational movement about the axis of the pivot shafts 68*a, b* controlled by the angular relationship of the control ring to the axis of the power output shaft 24. As aforedescribed, in the illustrated embodiment the control ring 84 lies in a plane subtending an angle of approximately 49° with the axis of the output shaft 24.

To assist in uniform rotation of the power output shaft 24 during operation, the rotary engine 10 may include a balanced flywheel, such as indicated at 130 in FIGS. 1 and 2, fixedly mounted on the tubular shaft 94 within the housing 56. Alternatively, the flywheel may be mounted externally of the housing 56 on the power output shaft 24.

In the operation of the rotary engine 10, when operated as a four-cycle internal combustion engine and assuming positions for the pistons 14 and 16 as shown in solid lines in FIG. 4, it is seen that the blade piston 14*a* and the juxtaposed blade piston 16*a* define a combustion chamber I therebetween adjacent the spark plug 38. Further assuming that a suitable fuel air mixture has previously been introduced and compressed between the opposed blade pistons 14*a* and 16*a* during initial cranking rotation of the power output shaft 24 by means (not shown) external to the motor housing, ignition of the spark plug 38 operates to ignite the fuel mixture and drive the blade piston 14*a* in a clockwise rotational direction to effect a corresponding rotation of the miter gear segment 58 and thereby a corresponding rotary movement of the connecting block 70 and power output shaft 24. Simultaneously, rotation of the miter gear segment 58 trys to rotate the carrier ring 66 about the axis of the pivot 68*a, b*, but such rotation of the carrier ring is constrained by the control ring 84 which is rotating about the axis of the power output shaft 24 through the action of the return gear assembly 26 in a direction opposite to the rotational direction of the power output shaft.

The relationship of the control ring 84 and the carrier ring 66 is established so that as the blade piston 14*a* undergoes rotation during a power stroke, the carrier ring 66 is caused to rotate about the axis of the pivot shafts 68*a, b* at a rotational speed sufficient to cause the gear segment 60 and associated piston 16 to be maintained in stationary positions relative to the piston chamber 30. During the power stroke of the blade piston 14*a* to the position shown in phantom in FIG. 4, the blade piston 16*a* acts as a stationary reaction surface for the combustion chamber I initially defined between the blade pistons 16*a* and 14*a* such that the forces of combustion rotate the blade piston 14*a* in a clockwise direction.

As the blade piston 14*a* passes through approximately 140° rotation to the position shown in phantom in FIG. 4 juxtaposed to the relatively stationary blade piston 16*b*, the spent gases from a previous combustion cycle, if any, which were in chamber II defined between the blade pistons 14*a* and 16*b* are exhausted through the exhaust port 44. Simultaneously, air previously introduced on the forward side of the piston 14*b* through the air inlet port 42 during initial rotation of the pistons 14 and 16, as during "starting" of the engine, is compressed in chamber IV defined between the blade piston 14*b* and the relatively stationary blade piston 16*a*. A fuel control system (not shown) of conventional design is operative to introduce a fuel charge through the fuel inlet port 40 into the reduced volume chamber IV between the blade pistons 14*b* and 16*a* when the blade piston 14*b* reaches the position shown in phantom in FIG. 4, preparatory to the next power cycle. It will be understood that suitable control valving (not shown) is associated with the fuel inlet port 40, air inlet port 42, and exhaust port 44 to control opening thereof in timed relation to the rotational positions of the pistons 14 and 16.

As the blade piston 14*a* rotates approximately 140° during its power cycle and reaches the phantom position shown in FIG. 4, the control ring 84 reaches a position wherein the plane of the raceway 126 is substantially coplanar with a plane containing the axes of the pivot shafts 68*a, b* and the radial stub shafts 120*a, b*. As the control ring 84 continues to rotate about the axis of the output shaft 24 with the plane containing the axes of shafts 68*a, b* and 120*a, b* being substantially coplanar with the plane of raceway 126, rotation of the carrier ring 66 about the axis of pivot shafts 68*a, b* is virtually stopped so that the pistons 14 and 16 become fixed together through engagement of their respective miter gears 60 and 58 with their associated miter gears 64 and 62, respectively, on the carrier ring. Such locking or coupling of the pistons 14 and 16 causes simultaneous rotation of the pistons, due to the inertia of the driven blade piston 14*a*, from the phantom line position of piston 14 and the full line position of piston 16 in FIG. 4 to the solid line positions of both pistons 14 and 16 illustrated in FIG. 5. In the latter position, the chamber IV between blade pistons 16*a* and 14*b* is disposed in a position juxtaposed to the spark plug 38, and the chamber II defined between blade pistons 14*a* and 16*b* is juxtaposed to the air inlet 42.

The ignition system for the spark 38 is timed so as to energize the spark and effect ignition of the fuel mixture in the newly positioned compression chamber IV as the pistons 14 and 16 reach positions as shown in FIG. 5. Thereafter, the blade piston 16*a* undergoes rotation during a power stroke or cycle and continues rotation of the power output shaft 24 through the action between the miter gears 60 and 64. During the power cycle of blade piston 16*a*, the control ring 84 again acts on the carrier ring 66 to maintain the previously advanced blade piston 14*b* stationary relative to the piston chamber 30 so that the blade piston 14*b* acts as a reaction surface for the combustion chamber. At the conclusion of each power cycle, the control ring 86 acts on the carrier ring 66 to effect simultaneous rotational advance of the pistons 14 and 16 to position a newly compressed fuel change in proper location for ignition by the ignition spark plug 38. The carrier ring 66 undergoes rotation about the axis of the pivot shafts 68*a, b* in a first rotational direction during approximately 164° rotation of the control ring 84 about the axis of the power output shaft 24, whereafter rotation of the carrier ring about the axis of shafts 68*a,b* is virtually stopped while the control ring rotates through the next approximately 16° about the output shaft, followed by rotation of the carrier ring about pivot shafts 68*a, b* in a reverse direction during the next approximately 164° rotation of the control ring 84 about its rotational axis, whereafter the carrier ring again stops rotation about the axis of the pivot shafts during the remaining 16° rotation of the control ring about the axis of the power output shaft to complete a full revolution.

The geometrical relationships of the various elements of the rotary engine 10 are such that in four-cycle operation, each of the blade pistons 14*a, b* and 16*a, b* undergoes a power stroke or cycle during each revolution of the power output shaft 24. It will be appreciated that while the engine 10 has been described with the pistons 14 and 16 rotating in clockwise directions, as viewed in FIGS. 4 and 5, the pistons may be caused to operate in a reverse rotational direction by proper relocation of the spark ignition 38, fuel inlet 40, air inlet 42 and exhaust port 44.

Suitable seals are provided throughout the rotary engine 10 as necessary to prevent leakage of lubricants and prevent entry of contaminants into the various operating sections.

While a preferred embodiment of the rotary engine 10 in accordance with the present invention has been illustrated and described, it will be understood to those skilled in the art that changes and modifications may be made therein without departing from the invention in its broader aspects.

Various features of the invention are defined in the following claims.

What is claimed is:

1. A rotary engine comprising:

housing means defining a substantially closed chamber, fuel inlet, fuel ignition and exhaust means communicating with said chamber in predetermined registration therewith, a pair of pistons supported within said chamber for rotation about a common axis, each of said pistons defining substantially diametrically opposed blade pistons extending outwardly from said common axis of rotation, first support shaft means supporting one of said pistons within said chamber for rotation about said common axis of rotation, second support shaft means rotatably supporting the other of said pistons within said chamber for rotation about said common axis of rotation and with its said opposed blade pistons being interposed between the blade pistons of said one of said pistons, said pistons being rotatable relative to each other and relative to said chamber so as to establish variable volume chambers between successive blade pistons, a power output shaft, and motion translation mechanism means interconnecting said first and second support shaft means to said power output shaft and operative to effect unidirectional rotation of said output shaft during cyclical rotation of said pistons, said motion translation mechanism means including carrier ring means connected to said output shaft and to said pistons so that rotation of said pistons effects a corresponding rotation of said output shaft, and control means being connected to said output shaft and said carrier ring means and adapted to effect predetermined movement of said carrier ring means in response to rotation of said pistons so that, in continuous predetermined sequence, a first one of said pistons rotates about its rotational axis in a power stroke upon selective ignition of fuel within said chamber while the other of said pistons remains substantially stationary relative to said chamber, and thereafter said first one of said pistons is maintained in substantially stationary relation to said chamber while the other of said pistons undergoes rotation during a power stroke upon further selective ignition of fuel within said chamber, whereafter said pairs of pistons are caused to undergo continued alternating rotational movement during power strokes so as to effect unidirectional rotation of said power output shaft, each of said first and second shaft means carrying a gear segment in fixed relation thereon, said carrier ring means including a pair of gear segments each of which is adapted for driven relation with one of said gear segments on said first and second shaft means, said carrier ring means being connected to said power output shaft so that rotation of either one of said gear segments on said first and second shaft means effects a corresponding rotation of said power output shaft, said control means being connected with said carrier ring means and adapted to effect predetermined movement thereof so that one of said pistons is maintained in substantially stationary relation to said chamber when the other of said pistons undergoes a power stroke, said control means including a control ring member lying in a plane subtending an angle of approximately 49° with the axis of said power output shaft and being coupled to said power output shaft in a manner to be rotated about an axis coincident with the axis of said output shaft in response to and in a rotational direction opposite to said power output shaft, said control ring member connected with said carrier ring means so as to effect said predetermined movement thereof.

2. A rotary engine as defined in claim 1 wherein said carrier ring means includes a carrier ring coupled to said output shaft so as to be rotatable about an axis transverse to the axis of said output shaft, said control ring member being operative to effect selective rotation of said carrier ring about said transverse axis in response to rotation of said output shaft so that one of said pistons is maintained in substantially stationary relation to said chamber while the other of said pistons undergoes a power stroke.

3. A rotary engine as defined in claim 2 wherein said control ring means is operative to maintain said carrier ring in nonrotating relation about said transverse axis during a predetermined period of each revolution of said output shaft so that said pistons undergo substantially simultaneous rotation during said predetermined period.

4. A rotary engine as defined in claim 3 wherein said control ring means is operative to effect said simultaneous rotation of said pistons at the conclusion of each successive power stroke.

5. A rotary engine as defined in claim 4 wherein said control ring means is operative to effect said simultaneous rotation of said pistons at least two times for each revolution of said power output shaft.

6. A rotary engine as defined in claim 2 wherein said control ring member defines an annular raceway, said carrier ring having two axially aligned stub shafts extending radially outwardly so that their common axis is normal and coplanar with said transverse rotational axis of said carrier ring, said stub shafts being received with said raceway and cooperative therewith so that rotation of said control ring member about its said axis of rotation is operative to effect said selective rotation of said carrier ring about its said transverse rotational axis.

7. A rotary engine as defined in claim 6 including bearing means interposed between said stub shafts and said annular raceway.

8. A rotary engine as defined in claim 6 wherein said control ring member is operative to reverse the rotational direction of said carrier ring about its said transverse rotational axis once for each full revolution of said power output shaft.

* * * * *